US006375258B1

(12) United States Patent
Fang

(10) Patent No.: US 6,375,258 B1
(45) Date of Patent: Apr. 23, 2002

(54) PORTABLE WORKSTOOL

(75) Inventor: Liping Fang, Placentia, CA (US)

(73) Assignee: Olympia Group, Inc., City of Industry, CA (US)

( * ) Notice: Subject to any disclaimer, the term of this patent is extended or adjusted under 35 U.S.C. 154(b) by 0 days.

(21) Appl. No.: 09/506,109

(22) Filed: Feb. 17, 2000

(51) Int. Cl.[7] ..... A47C 7/62
(52) U.S. Cl. ..... 297/188.08; 224/155; 297/129
(58) Field of Search ..... 297/188.08, 188.1, 297/188.13, 129, 52, 188.12, 188.2; 224/155, 156, 652, 684

(56) References Cited

U.S. PATENT DOCUMENTS 2,375,819 A * 5/1945 Reid ..... 297/188.13 X
3,730,294 A * 5/1973 Thurmond ..... 297/188.1 X
4,387,924 A * 6/1983 Fernandez ..... 297/188.01
5,722,717 A * 3/1998 Rettenberger ..... 297/188.13 X
5,829,835 A * 11/1998 Rogers et al. ..... 297/129 X
5,927,798 A * 7/1999 Ahn ..... 297/129
5,957,349 A * 9/1999 Krulik ..... 297/129 X
6,000,752 A * 12/1999 Shyr ..... 297/188.13 X
6,048,023 A * 4/2000 Lampton ..... 297/52 X

* cited by examiner

*Primary Examiner*—Peter M. Cuomo
*Assistant Examiner*—Stephen Vu
(74) *Attorney, Agent, or Firm*—Stallman & Pollock LLP

(57) ABSTRACT

A portable workstool suitable for carrying or use by a human subject is provided. The workstool includes a stoolmember having a frame and a pad. A detachable pouch having two handles for portability is connected to the stoolmember. The stool is placed in a functional mode for sitting and working in the conventional fashion. The pouch is configured to provide ergonomic storage and access to tools and the like while providing space-efficient storage of such because the pockets are immediately beneath the user. In particularly preferred embodiments, each pocket has a plurality of cells so that the user may conveniently store and locate tools without breaking visual contact with the work

8 Claims, 3 Drawing Sheets

PORTABLE WORKSTOOL

BACKGROUND OF THE INVENTION

This invention relates to a portable workstool and more particularly to a portable workstool which provides for ergonomic storage and use of tools with optimum space-efficiency.

Workstools have played a very important role in many practical endeavors. Electricians, fishermen and gardeners are only three obvious examples of the nearly infinite uses of the workstool. The conventional workstool, or campstool, suffers from several deficiencies. First, it is not conveniently portable because after folding, it must be separately carried, e.g. by the frame, and so tools or other articles must be separately carried by the user. Further, any tools used must be placed on the ground or stored on some other adaptive surface. This can be inconvenient for three major reasons. First, if there is no suitable storage area for the tools nearby, it may be necessary to place them more than arm's length away, for example in an uneven or tight working space. Secondly, if the tools are placed on the ground, the user must bend over to store or retrieve the tool and such action is often ergonomically undesirable or even impractical. Third, even if the tools may be stored close by, the storage or retrieval of such tools may require visual inspection. In other words, the user may have to glance away from his work site to the general location of the tool storage area in order to retrieve or replace the tool. This is also often undesirable or even impractical with detailed work. What is needed is a workstool which is not only easily portable but one which is functionally superior to a conventional workstool by virtue of being ergonomically advantageous and space-efficient in the utilization of tools.

SUMMARY OF THE INVENTION

In accordance with the present invention, a portable workstool provides convenient portability, ergonomic storage and space-efficiency when in use. The portable workstool is suitable for carrying or use by a human subject, the stoolmember utilizing both a frame and a pad. The frame includes a firs rectangular leg and a second rectangular leg pivotally interconnected. The pad presents a die-cut pattern to form two sleeves slidably connected to the first leg and two sleeves slidably connected to the second leg. The workstool also features a detachable pouch having a substrate with a left side, a right side and a ground side, as well as first and second handles. The pouch also includes fastening structure configured to attach to the four sleeves. The left side and the right side of the pouch each contain a pocket. In preferred embodiments each pocket has a plurality of cells, e.g. three cells on each side.

In functional mode, the two legs are pivoted so that the pad is taut. The two legs are, in effect, placed on a planar surface such as the ground. The taut pad may be securely sat upon with the pouch providing ergonomic and convenient access to the pockets. The workstool is space efficient because the pockets are disposed beneath the human subject.

DESCRIPTION OF THE PREFERRED EMBODIMENTS

Figure 1:
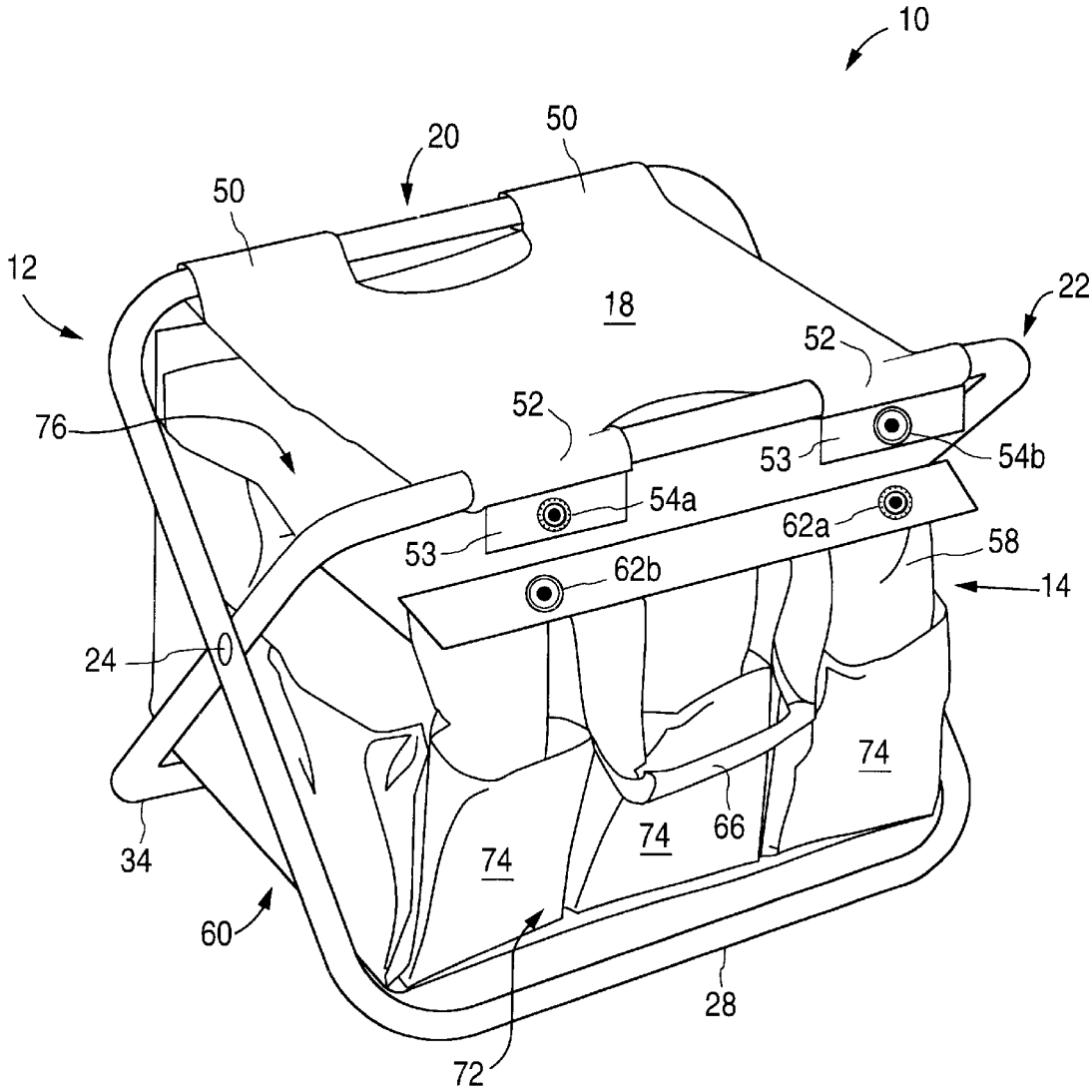
FIG. 1 is a perspective view of a portable workstool set up in functional mode in accordance with the present invention.

Referring to the drawings in general and FIG. 1 in particular, a portable workstool 10 is shown in accordance with the present invention. Workstool 10 includes a stoolmember 12 and a detachable pouch 14. Workstool 10 can be carried in a portable mode or a human subject or user (not shown for ease of illustration) can sit on workstool 10 and utilize pouch 14 in accordance with the invention.

Figure 2:
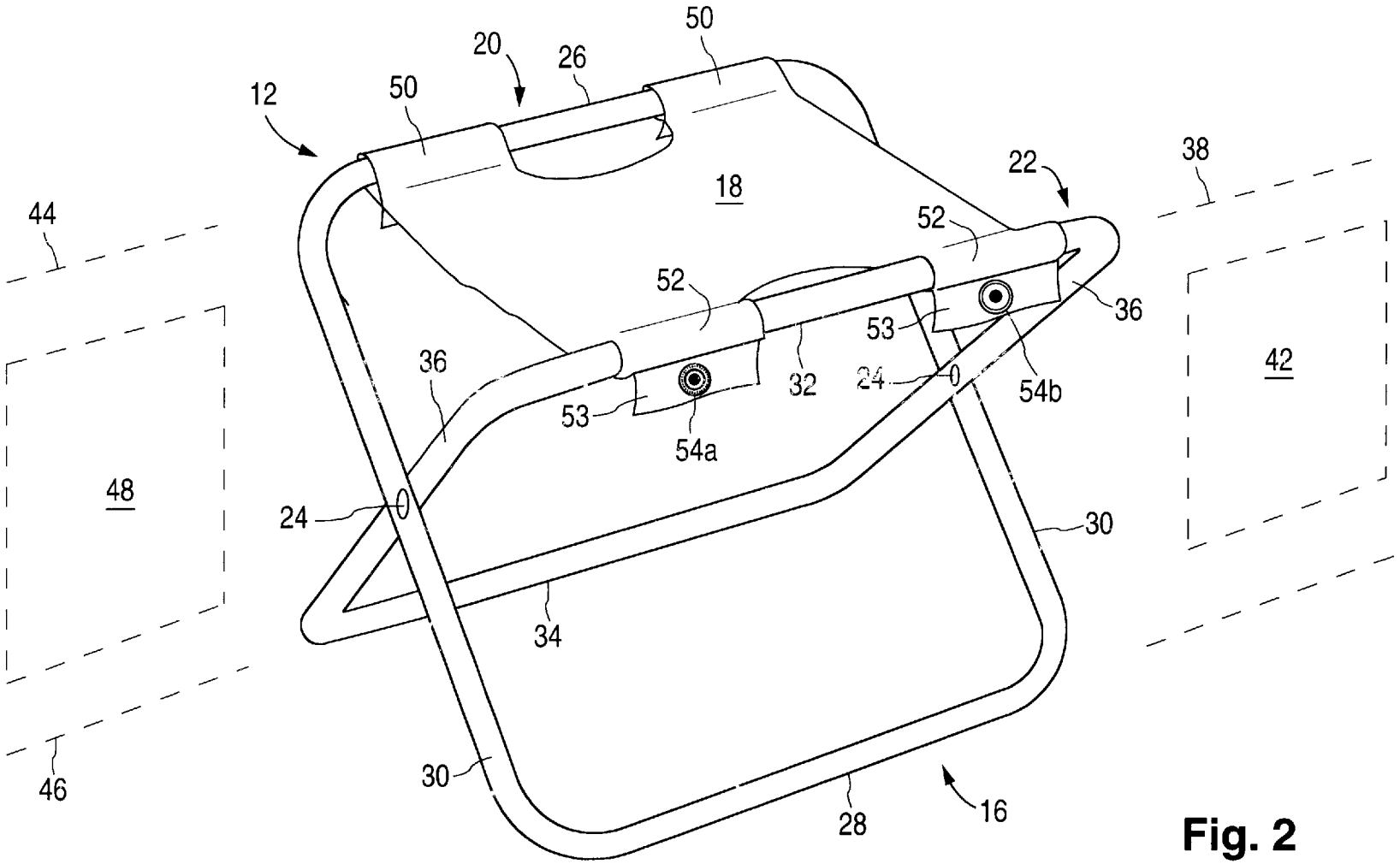
FIG. 2 is a perspective view of the stoolmember alone in functional mode.

Referring to FIG. 2, stoolmember 12 is shown without pouch 14 (see FIG. 1) for clarity of illustration. Stoolmember 12 includes a frame 16 and a pad 18. Frame 16 has a first leg 20 and a second leg 22. First leg 20 and second leg 22 are pivotally interconnected by pins 24. Legs 20, 22 and pins 24 are preferably made of metal or any other suitably rigid and durable material.

First leg 20 includes a pad spar 26, a ground spar 28 and two support members 30. It will readily be seen that first leg 20 and second leg 22 are both rectangular in shape.

Second leg 20 includes a pad spar 32, a ground spar 34 and two support members 36.

An axial projection 38 of pad spar 32 of second leg 22 is shown at the right side of FIG. 2. Likewise, an axial projection 40 of ground spar 28 of first leg 20 is also shown to the right of FIG. 2. It will readily be seen that axial projection 38 and axial projection 40 define and present a plane 42 which is illustrated as a plane segment for ease of illustration.

An axial projection 44 of pad spar 26 of first leg 20 is shown at the left side of FIG. 2. Likewise, an axial projection 46 of ground spar 34 of second leg 22 is also shown to the left of FIG. 2. It will readily be seen that axial projection 44 and axial projection 46 define and present a plane 48 which is illustrated as a plane segment for ease of illustration.

Pad 18 has two first-leg sleeves 50 which are axially slidably attached to first leg 20 at pad spar 26 as shown. Pad 18 has two second-leg sleeves 52 which are axially slidably attached to the second leg 22 at pad spar 32 as shown. Pad 18 is preferably formed of a synthetic resin material, but can be made from any suitable material with or without an integrated cushion.

Figure 4:
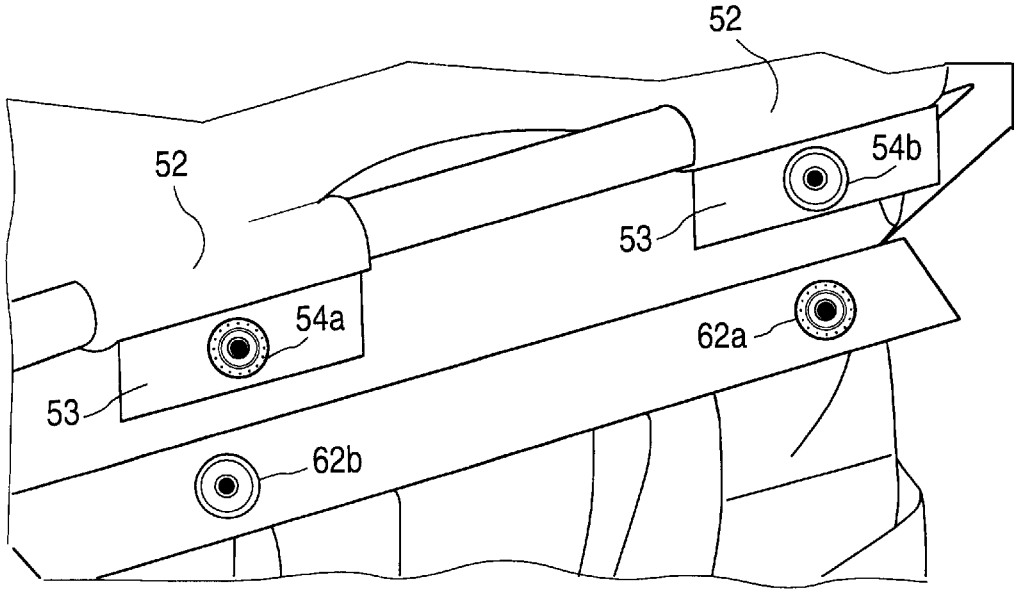
FIG. 4 is a detailed view of a portion of the portable workstool of FIG. 1.

Referring to FIG. 4, second-leg sleeves 52 each include a flap 53 and respectively a male pad snap 54*a* and a female pad snap 54*b*. (Note that the first sleeves 50 have associated flaps 53 and respectively a male pad snap 54*a* and a female pad snap 54*b*; such flaps 53, male pad snap 54*a* and female pad snap 54*b* associated with first sleeves 50 not being shown for economy of illustration; note also that directly across from male pad snap 54*a* as shown in FIGS. 1 and 4 is female pad snap 54*b* on first sleeve 50 and that directly across from female pad snap 54*b* as shown in FIGS. 1 and 4 is male pad snap 54*a* on first sleeve 50.)

Although pad 18 includes structure presenting a die-cut pattern to form two first-leg sleeves 50 and two second-leg sleeves 52, the two first-leg sleeves 50 permanently, slidably attaching first leg 20 to the remaining portions of the pad 18, and the two second-leg sleeves 52 permanently, slidably attaching second leg 22 to remaining portions of pad 18, all in the preferred embodiment, those skilled in the art will readily appreciate that alternative designs without a die-cut pattern could be utilized. For example, in an alternative embodiment (not shown), the first leg sleeves 50 can be formed as a single, continuous sleeve, and the second leg sleeves 52 can be similarly formed as another single, continuous sleeve. Alternatively, pad 18 can be permanently or removably attached to pad spars 20 and 22 or to itself with other suitable fastening means such as snaps, buttons, hooks or Velcro-type fasteners. Also, snaps 54*a* and 54*b* can be attached directly to pad spars 20 and 22 directly or through sleeves 50 and 52, rather than attached to flaps 53 as shown.

Figure 3:
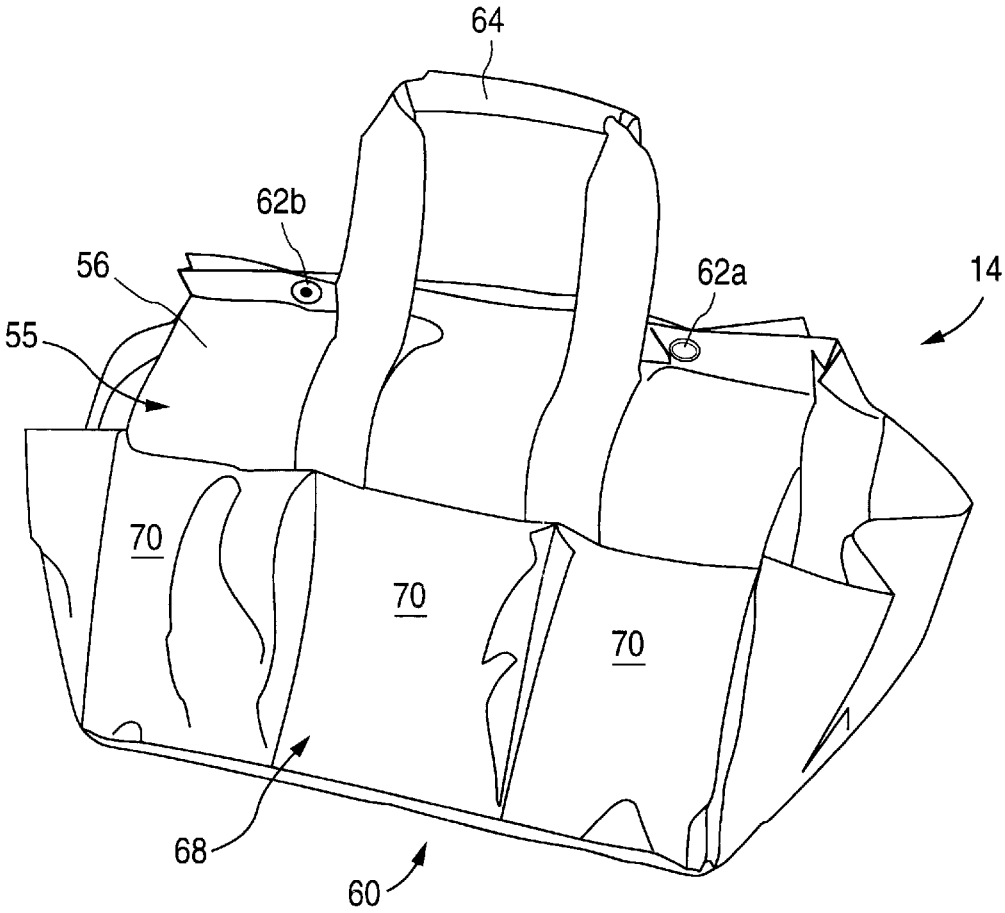
FIG. 3 is a perspective view of the detachable pouch alone.

Referring to FIG. 3, pouch 14 is shown detached from the rest of workstool 10. Pouch 14 has a substrate 55 presenting a left side 56, a right side 58 (see FIG. 1) and a ground side 60 (see also FIG. 1).

Still referring to FIG. 3, pouch 14 has fastening structure in the form of two male pouch snaps 62*a* and two female pouch snaps 62*b* (note that only one male pouch snap 62*a* and one female pouch snap 62*b*, both located on left side 56 of pouch 14 are visible in FIG. 3 due to the angle of viewing but the other male pouch snap 62*a* and female pouch snap 62*b* associated with right side 58 of pouch 14 are visible in FIG. 1 from a different perspective). It will be readily appreciated that on both sides of pouch 14 male pouch snaps 62*a* and female pouch snaps 62*b* are disposed in complementary fashion to male pad snaps 54*a* and female pad snaps 54*b*. This arrangement of snaps allows pouch 14 to be attached to the stool facing in either direction, while permitting the same snaps 62 to be used to close pouch 14 when it is detached from the stool.

As will be readily appreciated by those skilled in the art, other numbered sets or configurations of snaps may be used and indeed other fastening structure such as velcro or buttons could be used for reversible attachment of pouch 14 to stoolmember 12.

Left side 56 of pouch 14 includes a left handle 64 and right side 58 of pouch 14 includes a right handle 66 (see FIG. 1 for right handle 66). Left side 56 includes a left-side pocket 68 having three cells 70 suitable for storage. Right side 58 includes a right-side pocket 72 having three cells 74 suitable for storage. Different numbers or arrangements of cells (not shown) can alternately be provided. However, it is preferable to have individual cells rather than a large, unitary pocket to organize tools in easily accessible positions, as will be further described below.

Still referring to FIG. 3, when carrying workstool 10 in its fully assembled configuration, a human subject will grasp left handle 64 and right handle 66 (it will be noted that right handle 66 is not visible in FIG. 3 and furthermore that pouch 14 is not shown in conjunction with stoolmember 12). It will be readily appreciated that when the human subject is carrying the workstool 10, pouch 14 will be in an upright position, as substantially shown in FIG. 3. The portable mode is beneficial because not only can workstool 10 be easily carried by handles 64 and 66, but also tools and other objects can be carried inside pouch 14 as at reference numeral 76 illustrated in FIG. 1. Also, items may be carried in cells 70 and 74 (see FIG. 1 for cells 74). In this fashion, workstool 10 can be used as a carrying case in its portable mode.

Referring to FIG. 1, workstool 10 is seen in its functional mode as noted above. Workstool 10 is placed in functional mode as any other conventional workstool, notably by pivotally adjusting first leg 20 and second leg 22 to form an oblique angle therebetween and ground spar 28 of first leg 20 and ground spar 34 of second leg 22 are placed on a substantially planar supportive surface such as the ground, then forces exerted by the planar surface on workstool 10 serve to maintain pad 18 in a substantially taut condition and therefore a human subject may securely sit on workstool 10 at pad 18. In accordance with the invention, when a human user is sitting on workstool 10 he has convenient storage areas in cells 70 and 74 (see FIG. 3 for cells 70) as well as inside pouch 14 as shown at reference numeral 76. Cells 70 and 74 are particularly ergonomically effective because they are at a higher elevation than the ground or other supporting planar surface so the user must not bend or reach as far to retrieve or replace tools. Furthermore, in accordance with the invention, the user can mentally designate a given cell by its position on left side 56 or right side 58 (and even its serial position with respect to the other cells on a given side) so that he may know precisely the location of a particular tool whenever he is ready to retrieve it. Hence, the user is not required to break visual contact with his work site if this is undesirable but may instead readily locate the tool by touch.

Finally and in accordance with the invention, the user need not utilize any further volume than already required by workstool 10 in its functional mode for storage of tools. As seen in FIG. 2, substantially parallel planes 42 and 48 describe the outer perimeter of the volume of workstool 10 in functional mode and it will be readily noted that in the preferred embodiment cells 70 and 74 are disposed between planes 42 and 48 and below the human subject when he is sitting on workstool 10. Hence, the volume already required for workstool 10 in functional mode may also be utilized for tool storage.

While this invention has been described with reference to the specific embodiments disclosed herein, it is not confined to the details set forth and the patent is intended to include modifications and changes which may come within and extend from the following claims.

What is claimed is:

1. A portable workstool suitable for carrying or use by a human subject, the workstool comprising:

a stoolmember having a frame and a pad, the pad permanently connected thereto, the frame including a first rectangular leg and a second rectangular leg pivotally interconnected, with the pad including structure presenting a die-cut pattern to form two first-leg sleeves and two second-leg sleeves, the two first-leg sleeves permanently, slidably attaching the first leg to a first remaining portion of the pad, and the two second-leg sleeves permanently, slidably attaching the second leg to a second remaining portion of the pad, the first leg including a first pad spar, a first ground spar, and first set of two support members integrally formed therebetween, the first pad spar, the first ground spar, and the two support members collectively defining a first-leg plane, the second leg including a second pad spar, a second ground spar, and second set of two support members integrally formed therebetween, the second pad spar, second ground spar, and the second set of two support members collectively defining a second-leg plane, the pad further including pad-attachment structure disposed between and integrally connecting the two first-leg sleeves and the two second-leg sleeves; and a detachable pouch including, fastening structure operatively configured with the two first-leg sleeves and the two second-leg sleeves, a substrate presenting a left side, a right side and a ground side, a first handle permanently affixed to the left side of the substrate, a second handle permanently affixed to the right side of the substrate, a left-side pocket permanently affixed to the left side of the substrate and featuring a first cell, a second cell and a third cell, such that when the first rectangular leg and the second rectangular leg are pivotally adjusted to form an oblique angle between the first-leg plane and the second-leg plane, and the first pad spar of the first leg and the second pad spar of the second leg are positioned on top of a planar surface so that forces exerted by the planar surface on the workstool maintain the pad in a taut condition, the human subject may sit on the pad with an ergonomically positioned, handle-equipped pouch below the pad.

2. The portable workstool of claim 1, wherein when the workstool is placed in the working position, the first ground spar of the first leg and the second pad spar of the second leg present a first working plane, and the second ground spar of the second leg and the first pad spar of the first leg present a second working plane such that at least one pocket of the detachable pouch is disposed between the first working plane and the second working plane.

3. The portable workstool of claim 1, wherein at least one pocket of the detachable pouch is positioned for easy access by the human subject without undue vertical reaching.

4. The portable workstool of claim 1, wherein the pad includes two male pad snaps and two female pad snaps, one of the male pad snaps disposed on each of the two first-leg sleeves and one of the female pad snaps disposed on each of the two second-leg sleeves, the fastening structure of the detachable pouch including two male pouch snaps and two female pouch snaps operatively configured in complementary fashion with the two male pad snaps and two female pad snaps for reversible snapping action.

5. The portable workstool of claim 1, wherein the substrate is substantially composed of a synthetic resin material.

6. The portable workstool of claim 1, wherein the substrate is configured so that when the detachable pouch is detached from the frame, the detachable pouch is suitable for use as a tote bag.

7. The portable workstool of claim 1, wherein the detachable pouch further includes a right-side pocket permanently affixed to the right side of the substrate and featuring a first cell; a second cell and a third cell.

8. A portable workstool alternately suitable for carrying and sitting upon by a human subject, the workstool comprising:

a frame having a first rectangular leg and a second rectangular leg, each of the legs having a pad spar, a ground spar, and two opposite support members connected there between, each of the support members of the first rectangular leg being pivotably attached to one of the support members of the second rectangular leg, such that the legs can be pivoted from a closed position in which the two pad spars are generally adjacent to each other to an open position in which the two pad spars are apart;

a pad for supporting the human subject in a sitting position, the pad having two opposite ends each for attaching at a junction to one of the pad spars such that when the legs are pivoted to the open position the pad spans between the two pad spars;

a detachable pouch having two opposite sides each removably attached near one of the junctions between the pad and the pad spars, the pouch having an interior cavity for receiving items, the pouch having two handles each fixedly attached to one of the two opposite sides of the pouch for allowing the subject to carry the pouch when the pouch is detached from the junctions, the pouch having a plurality of exterior cells located on at least one of the opposite sides for holding tools in an easily accessible position below one of the pad spars, and wherein fasteners are provided along a top portion of each of the two opposite sides of the pouch for removably attaching to mating fasteners located near the junctions between the pad and the pad spars, the fasteners being arranged such that when the pouch is removed from the workstool legs and pad, each of the fasteners on one of the two opposite sides of the pouch can be removably mated to one of the other fasteners on the opposite side of the pouch to releasably close a top opening of the interior cavity of the pouch, and wherein a first flap and a laterally spaced second flap depends from each of the two pad spars, a male snap being fixedly attached to each of first flaps and a female snap being fixedly attached to each of the second flaps, the first flaps with their male snaps being located diagonally opposite each other and the second flaps with their female snaps being located diagonally opposite each other.

* * * * *